US010537138B2

(12) United States Patent
Li et al.

(10) Patent No.: US 10,537,138 B2
(45) Date of Patent: Jan. 21, 2020

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Changzheng Dai, Shenzhen (CN); Yonglu Guo, Shenzhen (CN)

(73) Assignee: Shenzhen First Union Technology Co., Ltd. (CN)

( * ) Notice: Subject to any disclaimer, the term of this patent is extended or adjusted under 35 U.S.C. 154(b) by 219 days.

(21) Appl. No.: 15/801,513

(22) Filed: Nov. 2, 2017

(65) Prior Publication Data

US 2018/0116290 A1 May 3, 2018

(30) Foreign Application Priority Data

Nov. 2, 2016 (CN) ..... 2016 2 1168582 U

(51) Int. Cl.
*A24F 47/00* (2006.01)

(52) U.S. Cl.
CPC ..... *A24F 47/008* (2013.01)

(58) Field of Classification Search
CPC ..... A24F 47/00
USPC ..... 131/328–329
See application file for complete search history.

(56) References Cited

U.S. PATENT DOCUMENTS

2014/0360514 A1 12/2014 Zhu
2015/0181943 A1* 7/2015 Li ..... H05B 3/48 131/329
2017/0251729 A1* 9/2017 Li ..... A24F 47/008

FOREIGN PATENT DOCUMENTS

CN 205196999 U 5/2016
CN 205337614 U 6/2016
EP 3025602 A2 6/2016
EP 3040095 A1 7/2016

* cited by examiner

*Primary Examiner* — Phuong K Dinh
(74) *Attorney, Agent, or Firm* — PROI Intellectual Property US

(57) ABSTRACT

An atomizer includes a mouthpiece assembly, a liquid supply assembly, a holder assembly, and an atomizing core. The liquid supply assembly includes a first liquid chamber, a second liquid chamber, an air pipe, a movable element, and an elastic element. A through hole is provided between the first liquid chamber and the second liquid chamber. The movable element is movable along the air pipe between a first position and a second position. When the holder assembly is engaged with the liquid supply assembly, the elastic element is compressed, the movable element is in the first position, and the first liquid chamber is in communication with the second liquid chamber via the through hole. When the holder assembly is detached from the liquid supply assembly, the elastic element drives the movable element to move to the second position, and the through hole is sealed.

10 Claims, 5 Drawing Sheets

ATOMIZER AND ELECTRONIC CIGARETTE HAVING SAME

CROSS REFERENCE TO RELATED APPLICATIONS

The present application claims priority to Chinese Patent Application CN 2016 211 685 82.5 filed on Nov. 2, 2016.

TECHNICAL FIELD

The present disclosure relates to smoking articles, and particularly, to an atomizer of an electronic cigarette and an electronic cigarette.

BACKGROUND

Cigarettes are favored by many people. However, some substances, e.g., tobacco tar, carbon monoxide, are harmful for human body. Especially, the tobacco tar includes a dozen carcinogen ingredients, which greatly damage health of human body. Nowadays, smoking (traditional cigarettes) in public places has been gradually prohibited in many countries. However, it is painful for smokers to quit smoking. Therefore, many substitutes of cigarettes appear on the market, such as smoking cessation tablets and electronic cigarettes.

In an electronic cigarette, a cartridge is heated to form aerosol, which has a similar taste as that of the cigarette. The electronic cigarette has a similar appearance and similar taste as the cigarette, and does not generate harmful substances, such as tar, suspended particles. Accordingly, the electronic cigarette is becoming more and more favored by most users.

In an atomizer of an electronic cigarette of related art, an atomizing core is usually a replaceable element. When replacing the atomizing core, if tobacco liquid in the atomizer is not used up, the tobacco liquid will leak out when taking out the atomizing core, causing inconvenience to users and affecting normal use.

SUMMARY

An atomizer includes a mouthpiece assembly, a liquid supply assembly, a holder assembly, and an atomizing core. A first end of the liquid supply is connected to the mouthpiece assembly, and an opposite second end of the liquid supply is coupled with the holder assembly. The atomizing core is arranged between the liquid supply assembly and the holder assembly. The atomizing core defines a liquid inlet. The atomizing core is configured for aerosolizing tobacco liquid to form aerosol. The liquid supply assembly includes a first liquid chamber, a second liquid chamber, an air pipe, a movable element, and an elastic element. The liquid inlet is in communication with the second liquid chamber, so that tobacco liquid in the second liquid chamber can enter the atomizing core for aerosolization. A through hole is provided between the first liquid chamber and the second liquid chamber. The movable element movably nests the air pipe, and the elastic element abuts against the movable element. The movable element is movable along the air pipe between a first position and a second position. When the holder assembly is engaged with the liquid supply assembly, the elastic element is compressed, the movable element is in the first position, and the first liquid chamber is in communication with the second liquid chamber via the through hole. When the holder assembly is detached from the liquid supply assembly, the elastic element exerts an elastic restoring force on the movable element, drives the movable element to move to the second position, the through hole is sealed, and the first liquid chamber is cut off from the second liquid chamber.

DETAILED DESCRIPTION

Figure 1:
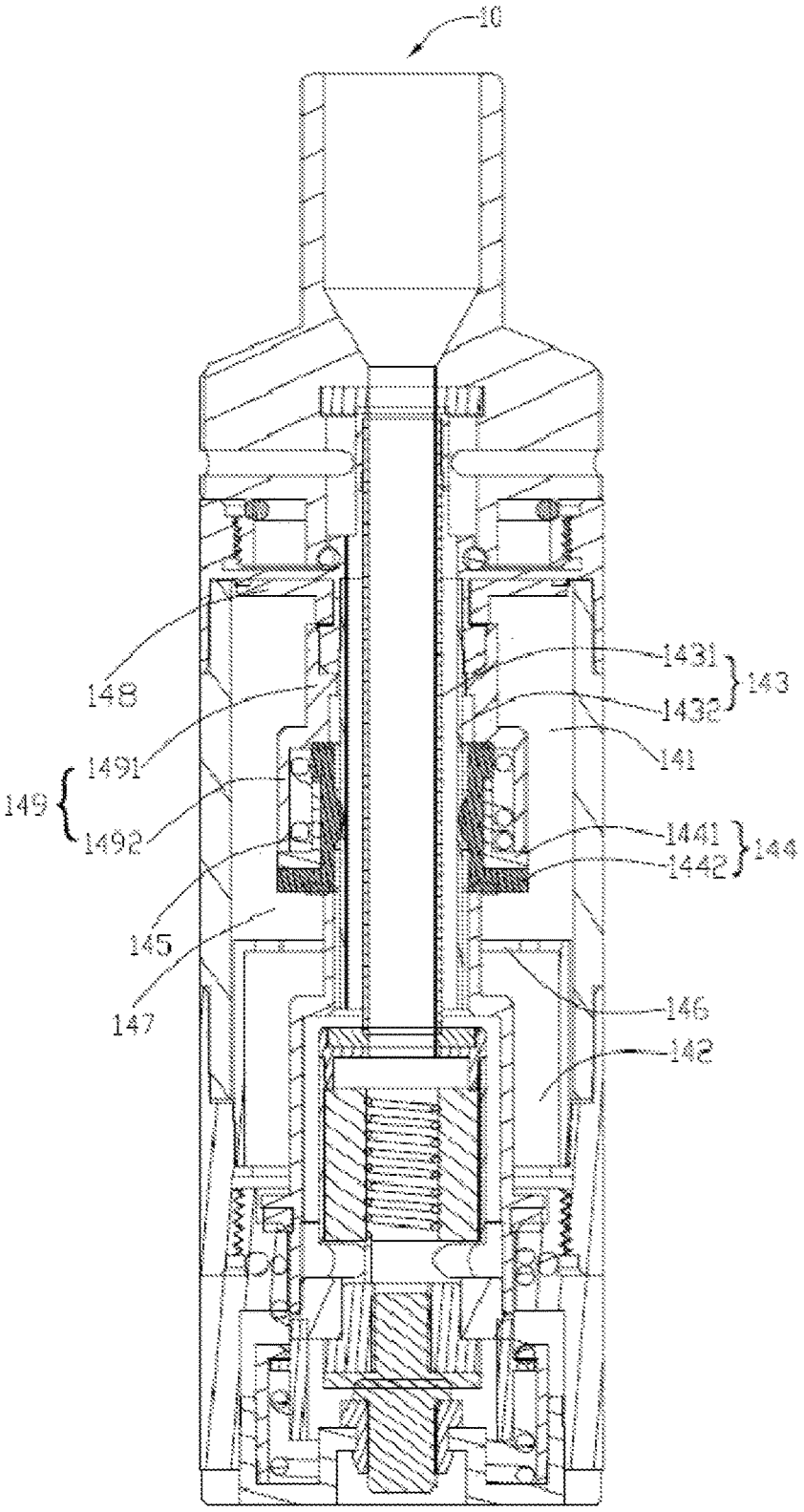
FIG. 1 is a cross-sectional view of an atomizer in a first state according to a first embodiment.
Figure 2:
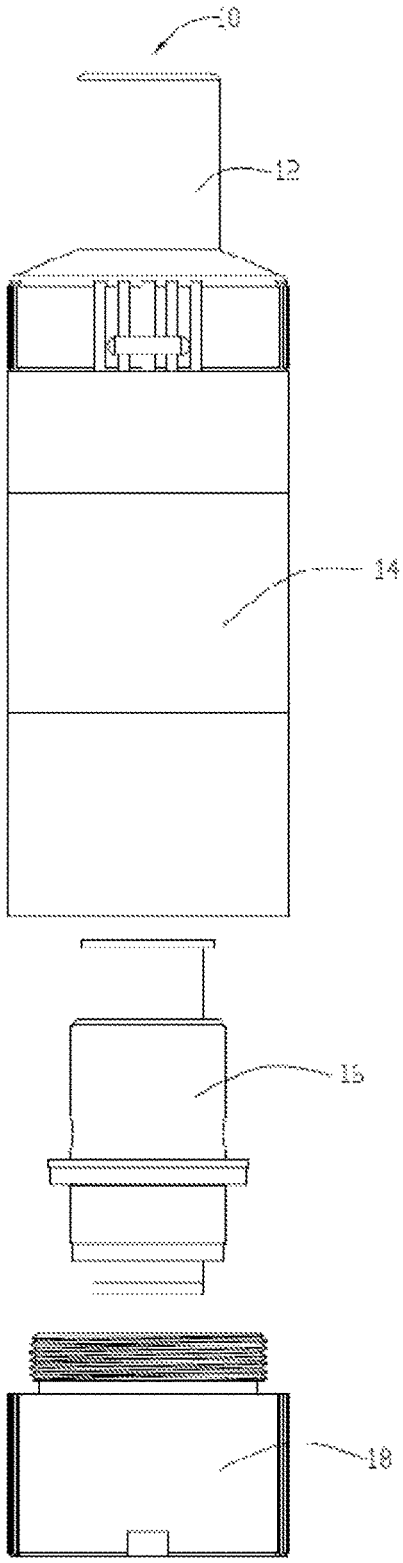
FIG. 2 is an exploded view of the atomizer of FIG. 1.
Figure 3:
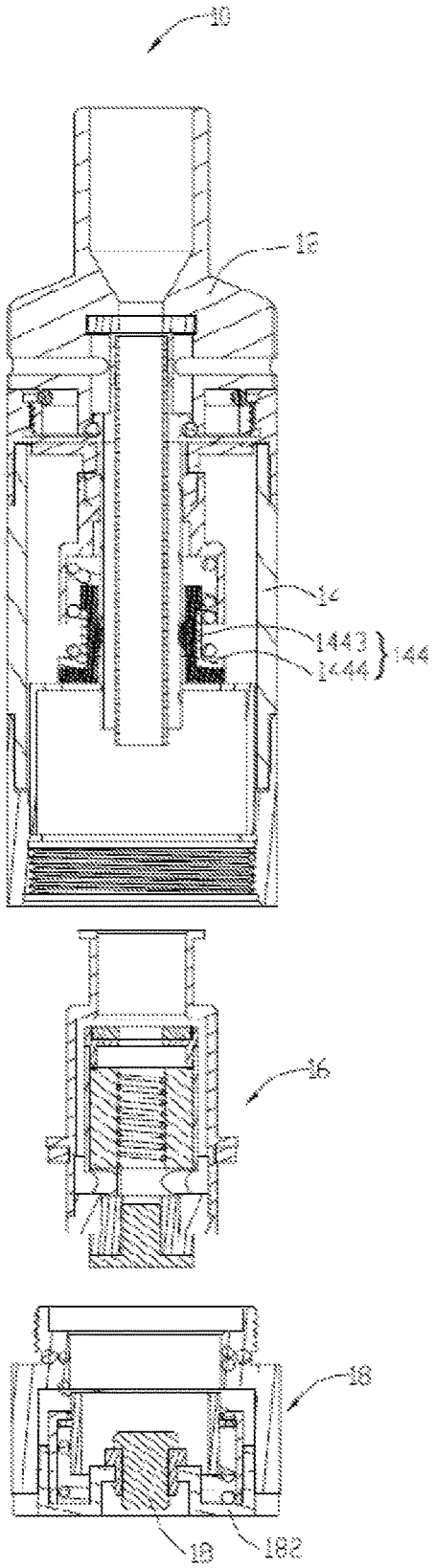
FIG. 3 is a cross-sectional view of the atomizer of FIG. 1 in a second state.
Figure 4:
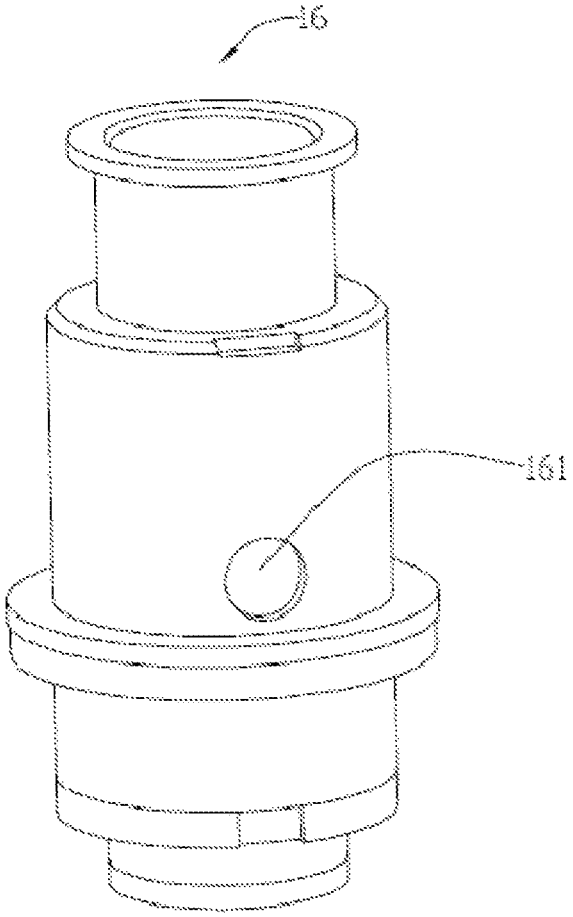
FIG. 4 is a perspective view of an atomizing core of the atomizer of FIG. 1.

The present disclosure will be described in detail as follows in view of several embodiments and the accompanying drawings.

Referring to FIGS. 1-4, an atomizer 10 includes a mouthpiece assembly 12, a liquid supply assembly 14, an atomizing core 16, and a holder assembly 18. The liquid supply assembly 14 is configured for storing tobacco liquid, a first end of the liquid supply assembly 14 is connected to a mouthpiece assembly 12, and an opposite second end is coupled with the holder assembly 18. The atomizing core 16 is arranged in the liquid supply assembly 14. The atomizing core 16 is configured for atomizing the tobacco liquid to form aerosol. The atomizing core defines a liquid inlet 161, so that the tobacco liquid in the liquid supply 14 can flow into the atomizing core 16 for aerosolization. The mouthpiece assembly 12 and the liquid supply assembly 14 are connected by a detachable connection, e.g., by screw threads. The liquid supply assembly 14 is engaged with the holder assembly 18 via a detachable connection, e.g., by screw threads.

The liquid supply assembly 14 includes a first liquid chamber 141, a second liquid chamber 142, an air pipe 143, a connecting element 149, a movable element 144, and an elastic element 145. Both the first liquid chamber 141 and the second liquid chamber 142 surround the air pipe 143. A through hole 146 is provided between the first liquid chamber 141 and the second liquid chamber 142. The liquid inlet 161 is in communication with the second liquid chamber 142. The air pipe 143 includes an inner air pipe 1431 and an outer air pipe 1432. The inner air pipe 1431 is in communication with the mouthpiece assembly 12 and inside of the atomizing core 16, so that aerosol generated by the atomizing core 16 can reach the mouthpiece assembly 12 via the inner air pipe 1431, and then be expelled via the mouthpiece assembly 12. The movable element 144 movably nests the air pipe 143. The movable element 144 includes a bracket 1441 and a silicone cushion 1442 nested in the bracket 1441. The bracket 1441 includes a tubular part 1443 and a flange 1444 extending outwards along a radial direction from the tubular part 1443. The tubular part 1443 movably nests the air pipe 143. The connecting element 149 includes a fixed part 1491 and a stepped part 1492 connected with the fixed part 1491. The fixed part 1491 and the stepped part 1492 are coaxially arranged, and the fixed part 1491 is fixedly arranged on the air pipe 143. One end the elastic element 145 abuts against a top surface of the bracket 1441, the other end of the elastic element 145 abuts against a bottom surface stepped part 1492. In the present embodiment, the elastic element 145 is a spring.

The movable element 144 is movable between a first position and a second position along the air pipe 143. When the holder assembly 18 is engaged with the liquid supply assembly 14, the atomizing core 16 pushes the movable element 144 to the first position, the elastic element 145 is compressed, and the first liquid chamber 141 and the second liquid chamber 142 are in communication with each other via the through hole 146. When the holder assembly 18 is detached, an elastic restoring force of the elastic element 145 drives the movable element 144 to move to the second position. In this position, the through hole 146 is sealed by the movable element 144, and the first liquid chamber 141 is cut off from the second liquid chamber 142, thus avoiding liquid leakage of the first liquid chamber 141.

Further, the liquid supply assembly 14 defines a liquid injecting opening 147 at an end adjacent to the mouthpiece assembly 12. The liquid injecting opening 147 is provided with a valve 148 configured for sealing the liquid injecting opening 147. In the present embodiment, the valve 148 is a silicone piece. When the mouthpiece assembly 12 is screwed off, an injecting nozzle of a liquid injecting container (not shown) can be used to pushes the silicone piece open, thus injecting tobacco liquid into the liquid supply assembly. After finishing injection, the injecting nozzle is moved out, and the silicone piece seals the liquid injecting opening 147 automatically. According, the atomizer 10 of the present embodiment can be used as an independent refillable atomizer.

The atomizing core 16 includes an atomizing cover 161, a liquid conducting body 162 arranged in the atomizing cover 161, and a heating element 163 arranged in the atomizing cover 161. Both the liquid conducting body 162 and the heating element 163 are arranged an axial direction of the atomizer 10, and the liquid conducting body 162 surrounds the heating element 163. The liquid conducting body 162 may be made of ceramic, or cotton. The heating element 163 may be a heating piece or a heating wire. In the present embodiment, the heating element 163 is a heating wire in a spiral form.

The holder assembly 18 includes a first electrode 181, and a second electrode 182 connected to a power supply. Two opposite ends of the heating element 163 are connected to the first and the second electrodes 181, 182, respectively. The first and the second electrodes 181, 182 are configured for electrically connected with the power supply.

Figure 5:
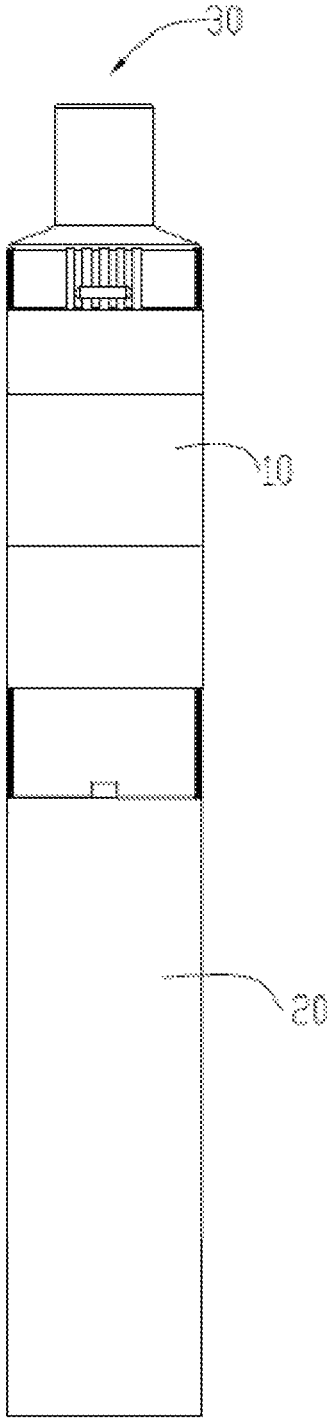
FIG. 5 is a schematic view of an electronic cigarette according to a second embodiment.

Referring to FIG. 5, an electronic cigarette 30 includes the above-mentioned atomizer 10 and a power supply 20. The power supply 20 is configured for supplying the atomizer 10 power.

In the present atomizer and electronic cigarette, when the holder assembly is separated from the liquid supply assembly, an elastic restoring force of the elastic element drives the movable element to move to the second position. In this position, the through hole is closed; the first liquid chamber is cut off from the second liquid chamber, thus avoiding liquid leakage when replacing the atomizer.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An atomizer, comprising:

a mouthpiece assembly;

a liquid supply assembly;

a holder assembly; and an atomizing core;

a first end of the liquid supply being connected to the mouthpiece assembly, and an opposite second end of the liquid supply being coupled with the holder assembly, the atomizing core being arranged between the liquid supply assembly and the holder assembly, the atomizing core defining a liquid inlet, the atomizing core being configured for aerosolizing tobacco liquid to form aerosol;

the liquid supply assembly comprising a first liquid chamber, a second liquid chamber, an air pipe, a movable element, and an elastic element, the liquid inlet being in communication with the second liquid chamber, so that tobacco liquid in the second liquid chamber can enter the atomizing core for aerosolization, a through hole being provided between the first liquid chamber and the second liquid chamber, the movable element movably nesting the air pipe, the elastic element abutting against the movable element;

wherein the movable element is movable along the air pipe between a first position and a second position, when the holder assembly is engaged with the liquid supply assembly, the elastic element is compressed, the movable element is in the first position, and the first liquid chamber is in communication with the second liquid chamber via the through hole;

when the holder assembly is detached from the liquid supply assembly, the elastic element exerts an elastic restoring force on the movable element, drives the movable element to move to the second position, and the through hole is sealed, the first liquid chamber is cut off from the second liquid chamber.

2. The atomizer according to claim 1, wherein both the first liquid chamber and the second liquid chamber surround the air pipe.

3. The atomizer according to claim 1, wherein the movable element comprises a bracket and a silicon cushion received in the bracket.

4. The atomizer according to claim 3, wherein the bracket comprises a tubular part and a flange extending outwards in a radial direction, the tubular part movably nests the air pipe;

the atomizer further comprises a connecting element nesting the air pipe, the connecting element comprises a fixed part and a stepped part connecting with the fixed part, the fixed part is fixed on the air pipe;

an end of the elastic element abuts against a bottom surface of the fixed part, and an opposite end of the elastic element abuts against a top surface of flange.

5. The atomizer according to claim 1, wherein the atomizing core comprises a liquid conducting body and a heating element, and the liquid conducting element surrounds the heating element.

6. The atomizer according to claim 5, wherein the heating element is arranged along an axial direction of the atomizer.

7. The atomizer according to claim 1, wherein the mouthpiece assembly is coupled to the liquid supply assembly via a detachable connection, the liquid supply assembly comprises a liquid injecting opening at an end connecting with the mouthpiece assembly, and the atomizer further comprises a valve arranged in the liquid injecting opening.

8. The atomizer according to claim 1, wherein the holder assembly is connected to the liquid supply assembly via screw threads.

9. The atomizer according to claim 5, wherein the holder assembly comprises a first electrode and a second electrode connected to a power supply, two opposite ends of the heating element are connected to the first and the second electrodes respectively, and the first and the second electrodes are configured for connecting with the power supply.

10. An electronic cigarette, comprising:

an atomizer according to claim 1; and a power supply configured for supplying the atomizer power.

* * * * *